US011420244B2

(12) United States Patent
Ernst De La Graete

(10) Patent No.: US 11,420,244 B2
(45) Date of Patent: Aug. 23, 2022

(54) ROLLING MILL WITH COOLING OR LUBRICATING DEVICE

(71) Applicant: FIVES DMS, Noyelles-les-Seclin (FR)

(72) Inventor: Conrad Ernst De La Graete, Noyelles-les-Seclin (FR)

(73) Assignee: FIVES DMS, Noyelles-les-Seclin (FR)

( * ) Notice: Subject to any disclaimer, the term of this patent is extended or adjusted under 35 U.S.C. 154(b) by 221 days.

(21) Appl. No.: 16/964,859

(22) PCT Filed: Jan. 23, 2019

(86) PCT No.: PCT/FR2019/050148
§ 371 (c)(1),
(2) Date: Jul. 24, 2020

(87) PCT Pub. No.: WO2019/145639
PCT Pub. Date: Aug. 1, 2019

(65) Prior Publication Data

US 2021/0060631 A1 Mar. 4, 2021

(30) Foreign Application Priority Data

Jan. 25, 2018 (FR) ..... 18 50594

(51) Int. Cl.
*B21B 45/02* (2006.01)
*B21B 13/02* (2006.01)

(52) U.S. Cl.
CPC ..... *B21B 45/0251* (2013.01); *B21B 13/02* (2013.01); *B21B 45/0233* (2013.01)

(58) Field of Classification Search
CPC . B21B 45/02; B21B 45/0203; B21B 45/0209; B21B 45/0215; B21B 45/0218;
(Continued)

(56) References Cited

U.S. PATENT DOCUMENTS 4,531,394 A 7/1985 Turley et al.
6,041,636 A 3/2000 Datzuk et al.
2016/0167097 A1* 6/2016 Ernst De La Graete ..... B21B 45/0233 72/201

FOREIGN PATENT DOCUMENTS

EP 0 121 811 10/1984
EP 1 721 685 11/2006
(Continued)

OTHER PUBLICATIONS

International Search Report, dated Jun. 4, 2019, from corresponding PCT application No. PCT/FR2019/050148, 5 pages.

*Primary Examiner* — Jessica Cahill
*Assistant Examiner* — Bobby Yeonjin Kim
(74) *Attorney, Agent, or Firm* — Nixon & Vanderhye

(57) ABSTRACT

Disclosed is a rolling mill including: a stand; two working rolls, two support rolls, and two intermediate rolls; lateral support rolls, able to support the working rolls laterally, each lateral support roll being borne by a support arm, mounted with the ability to pivot; load spreading beams and a mechanism for applying a preload on each support arm, including at least one preload actuating cylinder; one or more spray nozzles for a lubricating/cooling fluid, and wherein at least one of the nozzles, is carried on one of the support arms and in which the fluid supply circuit for the at least one nozzle comprises a device for connection/disconnection with the support arm with actuator. The actuator is an actuator distinct from the actuating cylinder of the mechanism for applying a preload.

20 Claims, 4 Drawing Sheets

(58) Field of Classification Search
CPC ..... B21B 45/0239; B21B 45/0233; B21B 45/0245; B21B 45/0248; B21B 45/0251; B21B 27/06; B21B 27/10; B21B 2027/103; B21B 13/145; B21B 29/00; B21B 13/147
USPC ..... 72/236, 201
See application file for complete search history.

(56) References Cited

FOREIGN PATENT DOCUMENTS

| | | | | |
|---|---|---|---|---|
| EP | 1721685 | A1 * | 11/2006 | ..... B21B 13/145 |
| FR | 3 008 633 | | 1/2015 | |
| WO | 2010/086514 | | 8/2010 | |
| WO | 2015/011373 | | 1/2015 | |

* cited by examiner

ROLLING MILL WITH COOLING OR LUBRICATING DEVICE

This application is the U.S. national phase of International Application No. PCT/FR2019/050148 filed Jan. 23, 2018 which designated the U.S. and claims priority to FR 18 50594 filed Jan. 25, 2018, the entire contents of each of which are hereby incorporated by reference.

BACKGROUND OF THE INVENTION

Field of the Invention

The invention relates to a rolling mill, and more particularly relates to the aspect of the cooling and/or the lubrication of the rolls of such a rolling mill.

The field of the invention is more particularly that of laterally supported Sexto stand rolling mills, and in particular rolling mills known under the name "Z High".

These rolling mills have application, in line, for example, in annealing and pickling lines or, off line, as reversing mills, for metal strips.

Description of the Related Art

A Quarto stand rolling mill comprises a stand wherein four rolls with parallel axes are provided, namely respectively two working rolls, lower and upper, defining the passage gap of the strip to be rolled, as well as two support rolls, upper and lower, bearing respectively against the working rolls of the side opposite that of the passage gap.

A Sexto rolling mill comprises two additional rolls with respect to a Quarto, namely two intermediate rolls inserted respectively between each working roll and the corresponding support roll.

In such rolling mills, each support roll and each intermediate roll, is rotatably mounted at its ends on chocks, by bearings, for example roller bearings or hydrastatic bearings.

These chocks are supports that can be displaced according to a direction parallel to the surrounding plane, between the two uprights of the stand.

Conventionally, balancing actuating cylinders allow for the displacement of the chocks of the intermediate rolls. These balancing actuating cylinders make it possible to change the relative position of the chocks and of the roll thereof, making possible among other things, to open the stand in order to facilitate the engagement of the product to be rolled, or to displace these elements in order to facilitate the disassembly of the rolls. These balancing actuating cylinders can also make it possible to bend the intermediate rolls. An advantage of a Sexto stand rolling mill is the possibility of using, in comparison with a Quarto stand, working rolls of a smaller diameter, which makes it possible to obtain a superior reduction in the thickness of the product to be rolled, for the same rolling force.

A Sexto rolling mill moreover offers the possibility of axially offsetting the two intermediate rolls, and with the purpose of applying the rolling force only on the width of the strip to be rolled, not over the entire length of the working rolls.

In a so-called "laterally supported" Sexto rolling mill, very often, the working rolls are not mounted on chocks, but on the contrary are provided as floating. It is then necessary to maintain the axial position thereof, by axial abutments, but also to maintain their lateral position using lateral support members, such as barrels or lateral support rollers disposed on either side of the surrounding plane.

It is known, for example, from document EP 0 121 811, in particular from the embodiment of FIG. 2, such a rolling mill of the Sexto type which comprises two working rolls, two support rolls and two intermediate rolls, inserted respectively between one of the working rolls and the corresponding support roll. In this document, the working rolls, the intermediate rolls and the support rolls are all mounted on chocks. Each working roll is laterally supported, on either side of the working roll, by two pairs of rollers. The rollers of the same pair are provided at the two ends of each working roll, at the ends of the roll which are not in contact with the strip to be rolled. The rollers are pivotably mounted on forks mobile in translation in relation to the upright of the stand, under the action of hydraulic actuating cylinders.

In FIG. 6 of this document, nozzles are provided carried on the support portion of the barrels, mobile in relation to the upright of the stand. To this effect, hoses are used to supply the nozzles with cooling and/or lubrication products, the hoses making it possible to take account of the displacements between the support portion, mobile, and the uprights of the stand. These nozzles allow for the lubrication and the cooling of the barrels and of the working roll, at the support zone of the rollers It is further known from document U.S. Pat. No. 4,531,394 another rolling mill design, of the laterally-supported Sexto type. Such a rolling mill still comprises two working rolls, two support rolls and two intermediate rolls, inserted respectively between one of the working rolls and the corresponding support roll. In this document, the support rolls and the intermediate rolls are mounted at the ends thereof on chocks, while the working rolls are provided as floating. Each working roll is laterally supported, on either side of the working roll, by a lateral support roll, itself bearing on two series of rollers disposed on the length of the roll.

In this rolling mill design, for each working roll, the two corresponding lateral support rolls are integral with two chocks of said intermediate roll. Each lateral support roll, as well as the upper barrels thereof are mounted on a support arm that extends between the two chocks of the intermediate roll, each support arm being mounted with the ability to pivot around a shaft of which the ends are integral with chocks.

The intermediate roll, chocks of the intermediate roll, support arm, (right and left), lateral support rolls and rollers, right and left, unit forms a self-supporting unit, commonly referred to as "cassette" or "insert» that can be introduced into the stand, or removed from the stand, during maintenance, by sliding the unit in the direction of the rolls.

Four load spreading beams extend rigidly between the two uprights of the stand, respectively, facing each support arm. Each load spreading beam supports a beam, referred to as preload, mobile in translation in relation to the corresponding load spreading beam, which can be displaced towards the inside of the stand in a substantially horizontal direction. Actuating cylinders make it possible to force the movable beam in contact with the pivoting support arm in order to preload the lateral support roll on the working roll.

In such a rolling mill, the cooling and the lubrication of the working roll and of the intermediate roll are carried out using nozzles, marked respectively 73 and 72 in FIG. 2 of document U.S. Pat. No. 4,531,394, physically at a distance from the working roll, located outside the "insert" or the "cassette". In FIG. 2, these nozzles are integral with the load spreading beam, or, with the movable preload beam. So that the stream can reach the intermediate roll, the nozzles, marked 72 are facing bores passing through the support arms. In practice and as far as the inventors are aware, this solution of spraying by bores of the support arms does not seem to be retained in rolling mills implemented industrially.

According to the observations of the inventors, the spray nozzles, marked 73 are not able to correctly cool the working rollers because they are located excessively far from the latter, their streams interfering excessively quickly with the lateral support arms, barrels and lateral support rollers and therefore not able to remount the scrolling of the strip. On the other hand, according to the observations of the inventors, the nozzles marked 72 are not capable of correctly lubricating the contact between the working roller and the intermediate roll because they are located excessively far from the latter. In use, such rolling mills with insert, have a limited service life for the working roll, due to the poor cooling thereof.

It is further known from document U.S. Pat. No. 6,041,636 another design of a rolling mill of the Sexto laterally-supported type, with "insert" or "cassette". As in the preceding document, the intermediate roll, chocks of the intermediate roll, support arms, (right and left), lateral support rolls and rollers, right and left, unit forms a self-supporting unit that can be introduced into the stand or removed from the stand during maintenance, by sliding the unit in the direction of the rolls.

In this document U.S. Pat. No. 6,041,636, the chocks of the intermediate rolls are mounted on camber blocks. The actuating cylinders of the camber blocks make it possible, during operation, to bring the intermediate rolls closer together, in a working position shown in FIG. 5 of this document, or to separate the intermediate rolls to a position, shown in FIG. 4, allowing for the removal of the inserts by sliding. These actuating cylinders can also make it possible, during operation to bend the intermediate roll.

In this document, it is known to supply with lubricant the bearings of the rollers of the support arms of the insert, from a source of lubricant. Devices for connection/disconnection make it possible, in the working position of the rolls, to connect the source of lubricant to lubrication bores provided in the chocks, and to automatically disconnect the bores when the intermediate rolls and the chocks thereof are vertically separated by the camber blocks. This automatic connection/disconnection is advantageous. No additional operation for connecting/disconnecting the source of lubricant is required during maintenance, in particular when the inserts have to be removed or inserted into the stand. To this effect, each device for connection comprises an element, marked 57 named "plunger", hollow, intended for conveying the lubricant, and which makes it possible, in the working position of the intermediate rolls, such as shown in FIG. 9, to join in a relatively sealed manner the bore of the chock by a seal. This element is movable, vertically in translation, forced towards its sealed position using a spring, marked 58. In the connection position, the lubricant flows from the source of lubricant through the movable element and to the bore of the insert. The lubricant then flows from the bore of the chock, and to the bearings through the hollow of the shaft, marked 17, on which the support arm is mounted with the ability to pivot. When the intermediate rolls are separated by the camber blocks to the removal position thereof, the stroke of the movable element is limited, less than the displacement stroke of the camber blocks, thus making it possible to guarantee an inter-space between the movable element and the chock, such as shown in FIG. 8 of document U.S. Pat. No. 6,041,636. It is then possible to remove the insert, without friction between the chocks and the movable element.

Such a device for connection/disconnection allows for the lubrication of the bearings of the support arms. However, this document does not address the problem of the cooling of the working rolls. As far as the inventors are aware, today still the cooling of the intermediate and working rolls and the lubrication of the contact intermediate roll/working roll in a reversing mill with "inserts" is still carried out by providing nozzles physically at a distance from the rolls.

It is known however from document EP 1 721 685 a rolling mill of the laterally-supported Sexto type, that improves the cooling of a working roll. This document proposes to improve the rolling mills from the prior art with "cassettes", for which there would not be any room for placing cooling nozzles as close as possible to the rollers. FIG. 2 shows the object of the improvement of the prior art EP 1 721 685.

The rolling mill is now a one-way (non-reversing) rolling mill which comprises, upstream, according to the direction of scrolling of the strip, a lateral support roll, such as described hereinabove, supported by a support arm. Downstream, the support arm is devoid of a roller or support roll. This support roll is replaced with a pad called a "support pad" which can be made of bronze or of a self-lubricating graphite material, intended for sliding on the surface of the working roller, without exerting any substantial force on the latter.

This support arm with pad carries several nozzles for a cooling liquid which makes it possible to directly cool the working roller, on the downstream side. Downstream, the lubricant liquid is supplied to the nozzles by the hollow shaft of the corresponding support arm. Upstream, the hollow shaft of the support arm is used to convey the lubricant to the bearings of the barrels supporting the lateral support roll. This document thus teaches how to improve the cooling of the working rolls. However, this improvement is done to the detriment of the supporting of the working roll on one of its sides, by suppressing a lateral support roll and by replacing it with a pad, as the rolling mill is then no longer a reversing mill.

It is further known from document WO 2010/086514 a method and a device for spraying a rolling installation. This document relates more particularly to the spraying of working rolls each laterally supported by a pair of rolls, and comprising at least one pair of support rolls for the transmission of a rolling force. This document is meant in particular as an improvement of the previously described document EP 1 721 685, a solution that would remain prohibited for reversing mills.

According to this document, a direct spraying of at least one portion of the working rolls is provided, on either side of said plane perpendicular to the scrolling direction of the strip.

According to this document, the nozzles are positioned on the supports of the lateral support rolls so as to directly spray the working roll of the two sides, laterally. However, the technology described in this document WO 2010/086514 is not a "cassette" technology as taught by documents U.S. Pat. Nos. 4,531,394, 6,041,636, EP 1 721 685 for which the intermediate roll, chocks of the intermediate roll, support arms, (right and left), latter support rolls and barrels, right and left, unit forms a self-supporting unit, called "insert" that can be introduced into the stand or removed from the stand during maintenance, by sliding the unit in the direction of the rolls.

The real difficulty in improving the spraying of the working rolls and of the intermediate rolls in a rolling mill with cassettes is not placing the spray nozzles in the cassette, but knowing how to supply them with lubricating/cooling fluid, and without increasing the duration of maintenance during removal or insertion operations of the cassette in the stand of the rolling mill. For example, it is excluded to use hoses between the cassette and the stand of the rolling mill to supply the nozzles, because the latter would require being dismounted and remounted during removal or insertion operations of the cassette, which would substantially prolong the time required for these maintenance operations.

Furthermore, and according to the observations of the inventor, placing the nozzles on the support of the lateral support roll so as to directly spray the working roll is not always possible, in particular when the working roll and the intermediate roll are of small diameter.

As described hereinabove, document U.S. Pat. No. 6,041,636 discloses automatic devices for connection that make it possible, in the working position of the rolls, to connect the source of lubricant to lubrication bores provided in the chocks, and to automatically disconnect the bores when the intermediate rolls are vertically separated by the camber blocks. However, such a device can be used only to supply with lubricant, either only the bearings of the barrels of the lateral support roll of a support arm, or only for supplying the nozzles of a support arm with fluid. This is the reason why the support arm of the nozzles is devoid of a lateral support roll in document EP 1 721 685, the latter being replaced with a pad which does not require any bearing to lubricate. Moreover, the device for connection in this prior art connects to the chocks which obliges conveying the fluid according to a complex trajectory through the hollow shaft and to the lower end of the support arm. This trajectory of the fluid, complex, from the chock to the support arm, through the hollow shaft, generates load losses, limiting the flow rates.

In sum, and according to the prior art that the applicant is aware of, in the aforementioned laterally-supported reversing mills of the Sexto type, with cassettes, the coolings of the working rolls and of the intermediate rolls are carried out using nozzles placed outside the cassette, physically at a distance from the working rolls and from the intermediate rolls and of which the streams cannot directly reach the working rolls. In this type of rolling mill implemented industrially, it is conventional to place a sprayer boom, on either side of the surrounding plane, carried on the load spreading beam of the stand and of which the streams are directed at the contact between the support roll and the intermediate roll. According to this arrangement, the lubrication of the working roll is therefore obtained, indirectly by the fact that the intermediate roll has been wetted and that this roll transports this lubrication during the rotation thereof by a half-turn, to the working roll. According to the observations of the inventors, this lubrication is insufficient, in particular for the rolls placed under the strip.

Furthermore, and when the speed of the rolling mill becomes substantial, the centrifugal force at the circumference of the intermediate roll tends to spin the roll in such a way that little cooling fluid reaches the working roll.

It is known however from document WO 2015/011373 from the present Applicant, a supported rolling mill of the Sexto type, with cassette technology which provides notable progress for the cooling of the working rolls, and in relation to the aforementioned prior art.

This is a laterally-supported Sexto rolling mill that includes:

- a stand comprising two pairs of uprights separated between them at the two ends of the stand, at least two uprights of the same pair defining an access window,
- two working rolls, able to surround a strip to be rolled, two support rolls, and two intermediate rolls, the support rolls and the intermediate rolls being rotatably mounted at the ends thereof on chocks,
- lateral support rolls, able to support the working rolls laterally, each lateral support roll being borne by a support arm, mounted with the ability to pivot on an axis,
- load spreading beams extending between the corresponding uprights of each pair, and means for applying a preload on each support arm, intended for engaging with one of the support arms at a support surface, and comprising at least one preload actuating cylinder integral with one of the load spreading beams,
- one or more spray nozzles for a lubricating/cooling fluid.

Each support arm of a lateral support roll is mounted with the ability to pivot on said axis, constituted by a shaft integral with the chocks of one of the intermediate rolls, with each intermediate roll, chocks of the intermediate roll, lateral support rolls and corresponding support arms forming a self-supporting unit, called insert (or "cassette"), which can be removed or inserted by sliding through the access window during maintenance, in the open position of the stand.

The hollow of the shaft can possibly be used, as in the prior art (see U.S. Pat. No. 6,041,636) to channel a fluid intended for lubricating the bearings of the barrels (marked 52 in FIG. 1) laterally supporting the lateral support roll.

According to the document WO 2015/011373, at least one of the nozzles is carried on one of the support arms in particular to allow for the lubrication/cooling of the working rolls and/or of the intermediate rolls.

Advantageously, the fluid supply circuit of said at least one nozzle comprises a device marked 13 for connection/disconnection that has:

- a duct of the support arm, intended for channelling the fluid, having a supply opening opening onto the support surface 10 of the support arm 6 intended for engager the means for applying a preload,
- a hollow portion, movable with respect to the load spreading beam, that can be displaced in relation to said load spreading beam 8 under the action of said means 9 for applying a preload.

According to the document WO 2015/011373, this hollow portion is configured to carry out a sealed connection with the supply opening on the support surface in a first connection position, on the contrary, retract into a second disconnection position, at a distance from the support surface.

In the first connection position, such as shown in FIG. 2, the cooling fluid can be channelled from the source to said at least one nozzle marked 12 (shown) or to said at least one nozzle marked 12' (not shown), through said device for connection/disconnection.

In the second disconnection position, the means for applying a preload are retracted, in the retracted position, said hollow portion being at a distance from the support arm.

This position makes it possible, in particular when the design of the rolling mill is of the insert (or cassette) type to be able to remove or insert the insert, without requiring and additional maintenance time to disconnect/connect the source of fluid.

Another advantage of such a device for connection/disconnection is that it connects directly to the support arm, not to the chocks of the intermediate roll as taught in the prior art known from document U.S. Pat. No. 6,041,636.

To arrive at the nozzle or in a rolling mill of the insert type WO 2015/011373, the fluid does not need to pass through the hollow shaft on which the support arm is mounted with the ability to pivot. It is then possible to substantially limit the load losses, and thus obtain fluid flow rates that are much higher than those obtained in this prior art, and thus substantially improve the cooling of the working rolls.

In summary the solution of the document WO 2015/011373 is advantageous in that the cooling/lubrication system does not complicate the maintenance operations of the rolling mill, and in particular the removal of inserts (or cassettes) from a laterally-supported Sexto rolling mill, thanks to its device for connection/disconnection while still authorising substantial fluid flow rates required to guarantee optimal cooling performance in that the fluid can be channelled from the hollow portion to the duct of the support arm, and without passing through the hollow of the shaft.

According to the observations of the inventor, such a design according to document WO 2015/011373 can be improved further in that it however has certain disadvantages:

during the rolling, the forces of the rolled strip on the rolls (working and lateral) can generate relative displacements (i.e. sliding) between the support arm marked 6 of the cassette, on the one hand, and the hollow portion marked 14 of the device for connection. These slidings are detrimental to the seal of the connection and are at the origin of cooling fluid leaks, and further, such a solution according to document WO 2015/011373 is very often provided native to the rolling mill, but becomes expensive when it entails improving the cooling of an existing rolling mill, in particular in that it requires reworking the load spreading beam and the means for applying a preload.

SUMMARY OF THE INVENTION

The purpose of the present invention is to propose a rolling mill that makes it possible to overcome the aforementioned disadvantages by proposing such a rolling mill of which the cooling/lubrication system of the strip or of the rolls does not complicate the maintenance operations of the rolling mill, and in particular the removal of the lateral support rolls, while still authorising substantial fluid flow rates and which can easily be implemented on an existing rolling mill to improve the cooling of the strip and/or of the rolls.

Another purpose of the present invention is to propose a rolling mill that authorises an effective cooling of the working rolls, even when the working roll even the intermediate roll, are of small diameters.

Another purpose of the present invention is to propose a rolling mill that authorises an effective cooling of the working rolls, even when the rolling mill has to operate at a substantial speed.

Another purpose of the present invention is to propose a method for obtaining a rolling mill in accordance with the invention from an existing rolling mill.

Other purposes and advantages shall appear in the following description and which does not have for purpose to limit it.

Thus the invention relates to a Rolling mill comprising:

a stand comprising two pairs of uprights separated between them at the two ends of the stand, at least two uprights of the same pair defining an access window, two working rolls, able to surround a strip to be rolled, two support rolls, and two intermediate rolls, the support rolls and the intermediate rolls being rotatably mounted at the ends thereof on chocks, lateral support rolls, able to support the working rolls laterally, each lateral support roll being borne by a support arm, mounted with the ability to pivot on an axis, load spreading beams extending between the corresponding uprights of each pair, and means for applying a preload on each support arm, intended for engaging with one of the support arms at a support surface, and comprising at least one preload actuating cylinder integral with one of the load spreading beams, one or more spray nozzles for a lubricating/cooling fluid, and wherein at least one of the nozzles is carried on one of the support arms and in which the fluid supply circuit for the said at least one nozzle comprises a device for connection/disconnection comprising:

a duct of the support arm, intended for channelling the fluid, having a supply opening opening onto the outer surface of the support arm located on the side of the means for applying a preload, a hollow connector, movable with respect to the stand, which can be displaced under the action of an actuator that can create a sealed connection with the supply opening on the outer surface in a first connection position, or on the contrary retract into a second disconnection position, at a distance from the outer surface.

According to the invention, said actuator is an actuator distinct from the actuating cylinder of said means for applying a preload.

According to optional characteristics of the invention, taken individually or in combination:

the connection end of the hollow connector and the seat around the supply opening intended for receiving as support said connection end include complementary reliefs, mutually engaged, prohibiting any relative sliding between the connection end of the hollow connector and the seat, in said first connection position;

the hollow connector is provided floating with respect to the frame of the stand, able to accompany the movements of the support arm during the rolling operations in the first connection position, said hollow connector being configured to be articulated with respect to the stand of the rolling mill so as to allow the end connection of the hollow connector to follow the movements of the support arm;

the hollow connector is a rigid body that forms a duct that has a free longitudinal end intended for being connected to or disconnected from the supply opening of the support arm, the other longitudinal end being integral with the actuator;

said actuator is an actuating cylinder of which the body of the actuating cylinder is fixed to a fixed stand portion, and the rod of the actuating cylinder is integral with said other end of the hollow portion, via an articulation;

the hollow connector includes at the connection end a ball joint system, including a first tubular part and a second tubular part having hemispherical contact surfaces, the first part rigidly integral with the body forming a hollow connector, the second part, free to be oriented with respect to the body of the hollow connector;

the rolling mill comprises means for adjusting the horizontal position of each load spreading beam, such as a screw/nut actuator, suitable for bringing closer together or separating the load spreading beam from a support arm facing, said spreading beam being in an adjustable position with respect to a fixed beam integral via its ends with two of the uprights at the two ends of the stand, and wherein said actuator is fixed to the fixed beam, connecting the fixed beam and the hollow connector, each lateral support roll is supported by backing rollers, the backing rollers being mounted on axes of the support arms by bearings, and wherein the support arm comprises a lubricant supply circuit for the bearings, distinct from the supply circuit of said at least one nozzle;

the lubricant supply circuit for the bearings comprises the shaft whereon is pivotably mounted the support arm, said shaft being hollow.

According to an advantageous embodiment, each support arm of a lateral support roll is mounted with the ability to pivot on said axis, constituted by a shaft integral with the chocks of one of the intermediate rolls, with each intermediate roll, chocks of the intermediate roll, lateral support rolls and corresponding support arms forming a self-supporting unit, called insert, said rolling mill comprising a lower insert and an upper insert, said inserts able to be removed or introduced by sliding through the access window during maintenance in an open position of the stand for which the upper and lower inserts are separated from the rolling plane, the upper and lower inserts able to switch to a working position in a closed stand position and wherein the device for connection is configured in such way that the passage from the second disconnection position to the first connection position, is obtained under the action of the deployment of the actuator in the open position of the stand, in the separated position of the lower and upper inserts, and wherein said hollow connector, even said actuator of the device for connection are articulated and configured in such a way that said hollow connector, even said actuator accompany the movement of the support arm to which said hollow connector is connected, from the open position of the stand to the closed position of the stand, said hollow connector switching then from a separated position of the load spreading beam to a position brought closer to the load spreading beam.

According to this embodiment, said actuator is said first actuator configured to deploy or retract said hollow connector so as to provide the switching from the second disconnection position to the first connection position, or inversely, in the open position of the stand and wherein a second actuator, independent of the first actuator (or a spring means) cooperates with said hollow connector and is configured to force said hollow connector into the first separated position of the load spreading beam when said hollow connector is in said second disconnection position. The second actuator can be fixed on a support integral with the load spreading beam.

The invention further relates to a method for obtaining a rolling mill according to the invention from an existing rolling mill including:

a stand comprising two pairs of uprights separated between them at the two ends of the stand, at least two uprights of the same pair defining an access window, two working rolls, able to surround a strip to be rolled, two support rolls, and two intermediate rolls, the support rolls and the intermediate rolls being rotatably mounted at the ends thereof on chocks, lateral support rolls, able to support the working rolls laterally, each lateral support roll being borne by a support arm, mounted with the ability to pivot on an axis, load spreading beams extending between the corresponding uprights of each pair, and means for applying a preload on each support arm, intended for engaging with one of the support arms at a support surface, and comprising at least one preload actuating cylinder integral with one of the load spreading beams, one or more spray nozzles for a lubricating/cooling fluid, method wherein the device for connection/disconnection is added to the existing rolling mill by implementing the following steps;

all or a portion of the existing support arms of the rolling mill are replaced with arms carrying said at least one of the nozzles, and including the duct having a supply opening, opening onto the outer surface is carried on one of the support arms, the hollow connector is added, movable with respect to the stand as well as the actuator, where applicable the first actuator, for the displacement of the hollow connector, able to create a sealed connection with the supply opening on the outer surface in the first connection position, or on the contrary retract into the second disconnection position, at a distance from the outer surface, and where applicable the second actuator, independent of the first actuator cooperates with said hollow connector and is configured to force said hollow connector into the first separated position of the load spreading beam.

BRIEF DESCRIPTION OF THE DRAWINGS

The invention shall be better understood when reading the following description, accompanied by annexed figures, among which.

DESCRIPTION OF THE PREFERRED EMBODIMENTS

Figure 1:
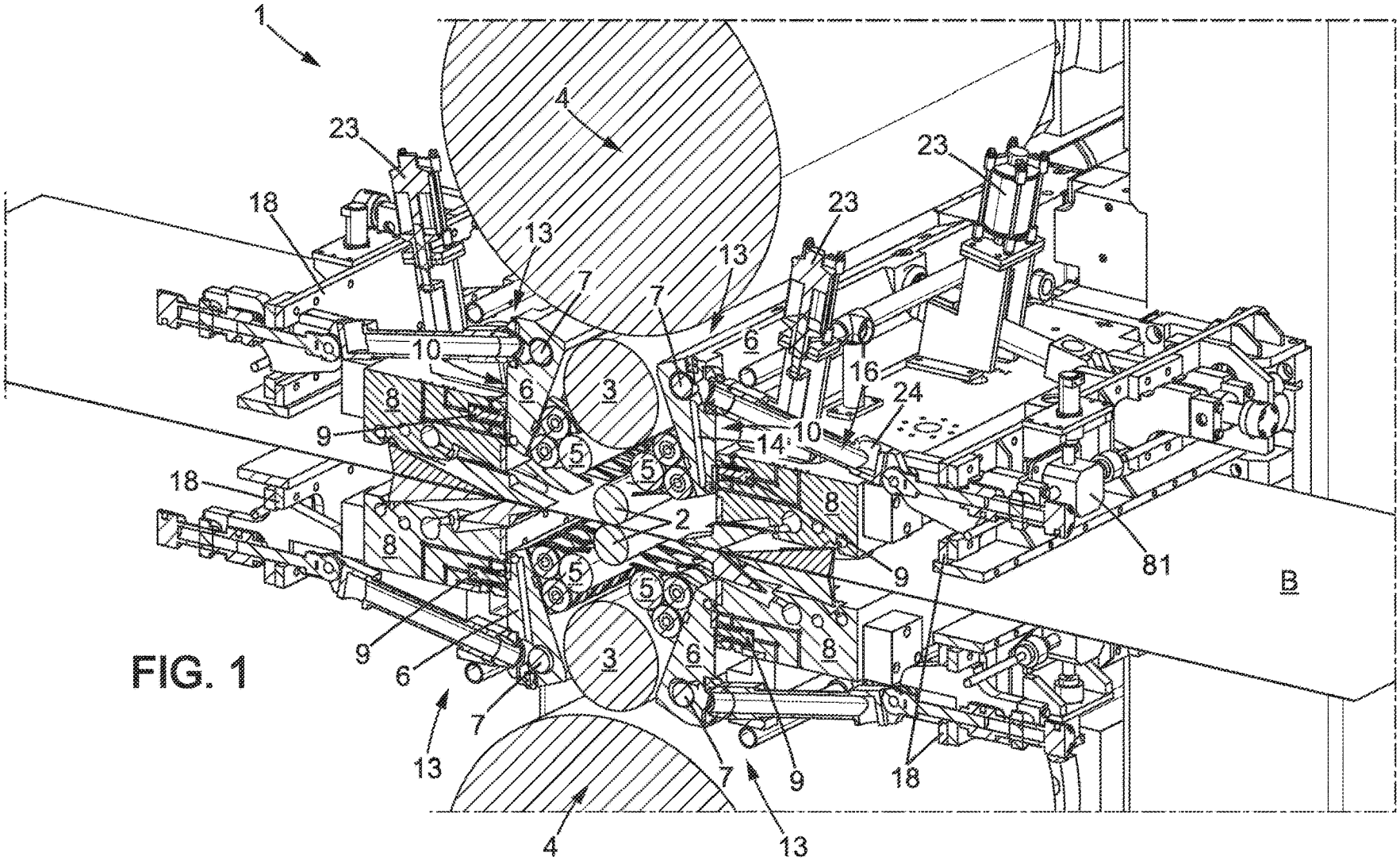
FIG. 1 is a perspective view, of a section of a rolling mill in accordance with the invention along a plane perpendicular to the direction of the rolls, showing the rolling mill in the open position of the stand for which the upper and lower inserts are separated from the rolling plane, and in the first connection position of the hollow connector.

Thus the invention relates first of all to a rolling mill 1 comprising:

a stand 30 comprising two pairs of uprights 31 separated between them at the two ends of the stand, at least two uprights of the same pair defining an access window, two working rolls 2, able to surround a strip to be rolled, two support rolls 4, and two intermediate rolls 3, the support rolls 4 and the intermediate rolls 3, being rotatably mounted at the ends thereof on chocks, lateral support rolls 5, able to support the working rolls 2 laterally, each lateral support roll being borne by a support arm 6, mounted with the ability to pivot on an axis 7, load spreading beams 8 extending between the corresponding uprights of each pair, and means 9 for applying a preload on each support arm 6, intended for engaging with one of the support arms at a support surface 10, and comprising at least one preload actuating cylinder 11 integral with one of the load spreading beams 8, one or more spray nozzles for a lubricating/cooling fluid.

The working rolls 2, the intermediate rolls 3 and the support rolls 4 are substantially with parallel axes, the axes of the rolls 2, 3, 4 being contained in a surrounding plane substantially perpendicular to the strip to be rolled B. The two working rolls 2 are located on either side of the strip to be rolled, their separation defining the passage gap in operation. Each intermediate roll 3 is inserted between the working roll 2 and the corresponding support roll 4. The working roll driven in rotation, indirectly by the rotating of the intermediate roll 3.

The lateral support rolls 5 are preferably in the number of two per working roll 2 and make it possible to maintain the working roll 2, laterally on the two sides of the surrounding plane. This is thus preferably a reversing mill. Each lateral support roll 5 is mounted on a support arm 6 mounted with the ability to pivot on an axis 7.

According to a preferred embodiment, each support arm 6 can be mounted with the ability to pivot on a shaft integral with its ends of the chocks of the intermediate rolls, such as taught by document U.S. Pat. No. 4,531,394 or document U.S. Pat. No. 6,041,636. In this rolling mill design, each intermediate roll 3, chocks of the intermediate roll, lateral support rolls 5 and corresponding support arms 6 form a self-supporting unit, commonly referred to as "insert" or "cassette", which can be removed or inserted by sliding through the access window during maintenance, at least in an open position Po of the stand for which the upper insert Isup and the lower insert Iinf are separated from one another, typically using balancing actuating cylinders of the rolling mill.

The load spreading beams 8 extend between the corresponding uprights of each pair, respectively facing each support arm 6, at least during operation. The means 9 for applying a preload on each support arm 6 are intended for engaging with one of the support arms at a support surface 10 and include at least one preload actuating cylinder 11 integral with one of the load spreading beams 8. The position of the load spreading beam 8 can be adjusted horizontally in relation to the uprights 31. To this effect, the rolling mill comprises means for adjusting the horizontal position of each load spreading beam, such as an actuator 81 in particular screw/nut, suitable for bringing closer together or separating the load spreading beam 8 of a support arm 6 facing. This spreading beam 8 is of an adjustable position typically in relation to a fixed beam 18, itself integral by its ends with two of the uprights 31 at the two ends of the stand. The actuator 81 is inserted between the load spreading beam 8 and this fixed beam 18. The synchronised screw/nut actuators 81 can be provided to move the load spreading beam closer to the support arm 6, or on the contrary separate the load spreading beam 8 from said support arm 6.

During operation, the working roll is generally forced to bear against the lateral support roll 5 upstream, along the scrolling direction of the strip B. The downstream load spreading beam 8, is positioned a few millimetres from the downstream support arm 6. The means 9 for applying a preload are then used to take up the slack and provide the contact of the downstream lateral support roll 5.

The rolling mill comprises said spray nozzles or nozzles for a lubricating/cooling fluid, these nozzles being in particular intended for cooling/lubricating the working rolls, directly or indirectly and/or the other rolls of the rolling mill.

According to the invention, at least one of the nozzles 12, is carried on one of the support arms 6, in particular to allow for the lubrication/cooling of the working rolls and/or of the intermediate rolls.

Advantageously, the fluid supply circuit of said at least one nozzle 12, comprises a device 13 for connection/disconnection comprising:

a duct 14 of the support arm 6, intended for channelling the fluid, having a supply opening 15 opening onto the outer surface of the support arm located on the side of the means 9 for applying a preload, a hollow connector 16, movable with respect to the stand 30, which can be displaced under the action of an actuator 17, able to create a sealed connection with the supply opening 15, on the outer surface 10, in a first connection position P1, or on the contrary retract into a second disconnection position at a distance from the outer surface 10.

According to the invention, the hollow connector 16 is able to create a sealed connection with the supply opening 15 on the outer surface 10 in a first connection position P1, on the contrary, retract into a second disconnection position, at a distance from the outer surface 10.

In the first connection position P1, the cooling fluid can be channelled from the source to said at least one nozzle marked 12 through said device for connection/disconnection 13. In the second disconnection position (not shown), the actuator 17 in the retracted position, said hollow connector 16 is at a distance from the support arm 6. This position makes it possible, in particular when the design of the rolling mill is of the insert (or cassette) type to be able to remove or insert the insert, without requiring additional maintenance time to disconnect/connect the source of fluid.

Another advantage of such a device for connection/disconnection is that it connects directly to the support arm, not to the chocks of the intermediate roll as taught in the prior art known from document U.S. Pat. No. 6,041,636. To reach the nozzle 12, in a rolling mill of the insert type according to the invention, the fluid does not need to pass through the hollow shaft on which the support arm is mounted with the ability to pivot. It is then possible to obtain fluid flow rates that are much greater than those obtained in this prior art.

In the invention, the hollow of the shaft can possibly be used, as in the prior art to channel a fluid intended for lubricating the bearings of the barrels 52 laterally supporting the lateral support roll 5. Thus and according to an embodiment, each lateral support roll 5 is supported by backing rollers 52, the backing rollers 52 being mounted on parallel axes 50, 51, of the support arm 6 by bearings. The support arm 6 comprises a lubricant supply circuit for the bearings, distinct from the supply circuit of said at least one nozzle 12. The lubricant supply circuit for the bearings can include the shaft on which the support arm 6 is pivotably mounted, said shaft being hollow, passed through at least partially by the lubricant. According to another embodiment (not shown), the supply circuit of the nozzle (comprising the device 13 for connection/disconnection) can also make it possible to convey a fluid to the bearings of the barrels 52 in order to ensure the lubrication thereof. Generally, the supply circuit comprising the device 13 for connection/disconnection can be applied to any fluid the requires transiting via the support arm 6 (and other than the cooling fluid of the rolls).

According to a notable characteristic of the invention, said actuator 17 is an actuator distinct from the actuating cylinder 11 of said means 9 for applying a preload.

Note that the supply opening 15 can be provided on the outer surface 10, of the arm 6 in the immediate vicinity of the axis 7 of rotation of the arm.

An interest in providing the actuator of the device for connection 13 as a distinct element of the actuating cylinder is to improve the cooling of an existing rolling mill, advantageously without having to modify the load spreading beam, or the means for applying a preload of the existing rolling mill.

It is further possible to substantially improve the seal between the supply opening 15 and the hollow connector 16, in the first connection position P1 with the following arrangements:

- the connection end of the hollow connector 16 and the seat around the supply opening 15 intended for receiving as support the connection end can advantageously include complementary reliefs, mutually engaged, prohibiting any relative sliding between the connection end of the hollow connector 16 and the seat, in said first connection position P1, and in this case,
- the hollow connector 16 is then preferably provided as floating in relation to the fixed frame of the stand, able to accompany the (slight) movements of the support arm 6 during rolling operations: to this effect the hollow connector 16 can be a freely articulated element in relation to the frame to the stand so as to allow the connection end of the hollow connector 16 to follow the movements of the support arm 6.

The hollow connector 16 can further include, at the connection end, a ball joint system, including a first tubular part 20 and a second tubular part 21 having hemispherical contact surfaces formant a ball: the first part 20 is rigidly integral with the body forming a hollow connector 16, the second part 21, being free to be oriented with respect to the body under constraint.

According to the embodiment (shown), the second part 21 can be dimensioned to be housed in a cavity forming a seat for the connection end of the hollow connector, in the first position P1 of the hollow connector.

The hollow connector 16 can be a rigid body that forms a duct that has a free longitudinal end intended for being connected to or disconnected from the supply opening 15 of the support arm 6, and another longitudinal end integral with the actuator 17. The actuator 17 is an actuating cylinder of which the body of the actuating cylinder is fixed to a fixed stand portion such as the fixed beam 18. The rod of the actuating cylinder is integral with said other end of the connector 16, via an articulation 19, such as a pivot (with an axis parallel to the working rolls), allowing the free inclination of the hollow connector 16 in relation to the actuator 17.

This is preferably an insert (or cassette) rolling mill design: preferably, each support arm 6 of a lateral support roll 5 is thus mounted with the ability to pivot on said axis 7, constituted by a shaft integral with the chocks of one of the intermediate rolls 3, each intermediate roll 3, chocks of the intermediate roll, lateral support rolls 5 and corresponding support arms 6 forming a self-supporting unit. The insert is called upper insert Isup when positioned above the surrounding plane, or lower insert Iinf when positioned below the surrounding plane.

In a manner well known to those skilled in the art, these inserts Iinf and Isup able to be removed or introduced by sliding through the access window during maintenance in the open position Po of the stand for which the upper and lower inserts Isup, Iinf are separated from the rolling plane, typically under the action of balancing actuating cylinders.

The upper and lower inserts can switch to a working position in the closed stand position Pc: the axial locking of the upper and lower inserts (Isup and Iinf) in relation to the stand of the rolling mill is then typically obtained during the closing of the stand, during the displacement of the lower and upper inserts from the separated position in the open position of the stand Po to their position brought closer together, namely in the closed position Pc of the stand of the rolling mill, and in away well known to those skilled in the art.

Figure 2:
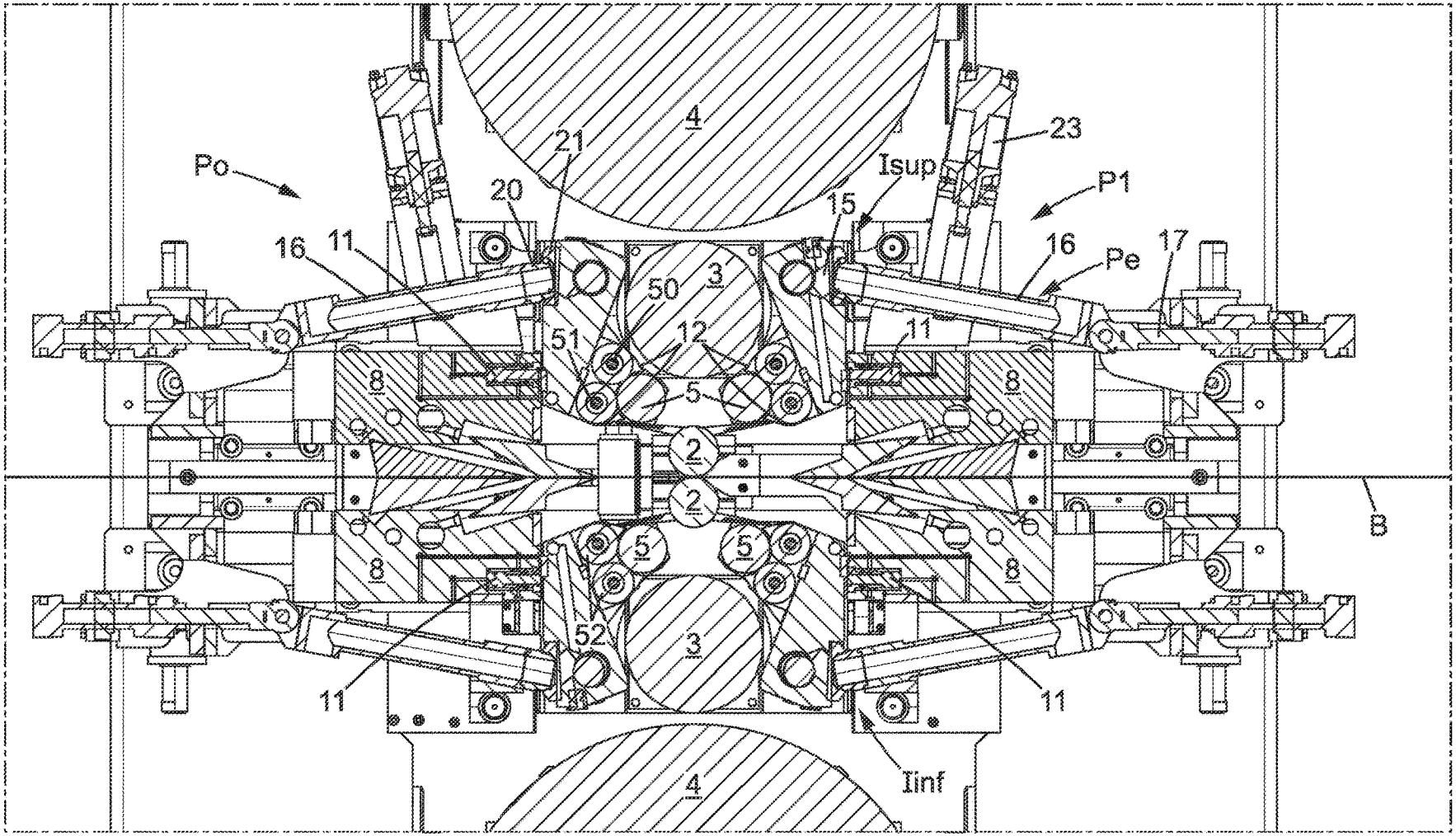
FIG. 2 is a detailed view of FIG. 1, showing the rolling mill in the open position of the stand for which the upper and lower inserts are separated from the rolling plane, and in the first connection position of the hollow connector, the hollow connector being tilted in a position separated from the load spreading beam.

Advantageously, the device for connection is configured in such way that the passage from the second disconnection position to the first connection position P1 is obtained under the action of the deployment of the actuator 17 in the open position Po of the stand in the separated position of the lower and upper inserts (open position shown in FIG. 1 or 2).

Figure 3:
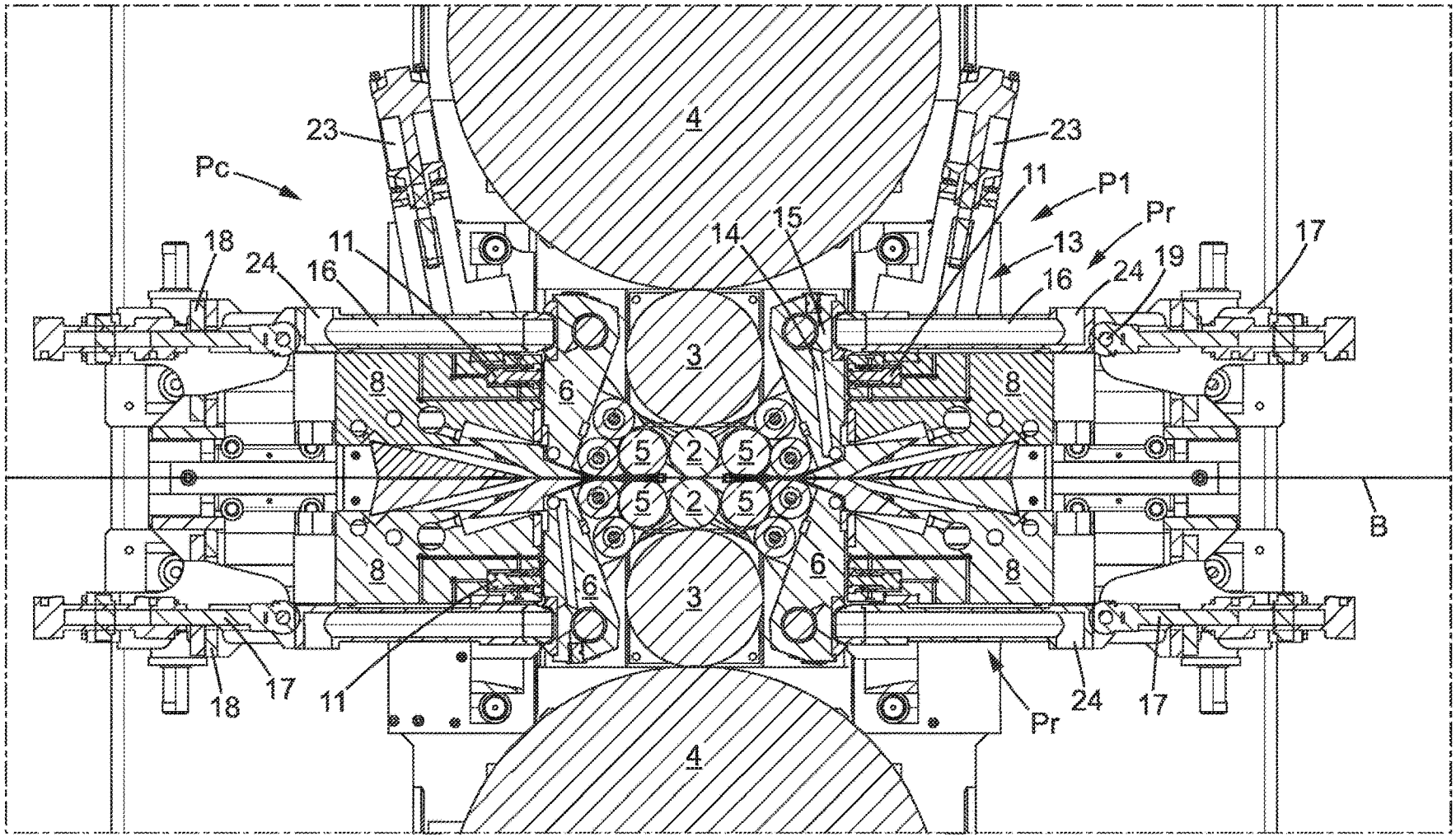
FIG. 3 is a view according to FIG. 2, after closing of the stand of the rolling mill for which the upper and lower inserts are brought closer to one another, the hollow connector connected to the supply opening of the arm accompanying the displacement of the arm, the hollow connector then being in a position brought closer to the load spreading beam.
Figure 4:
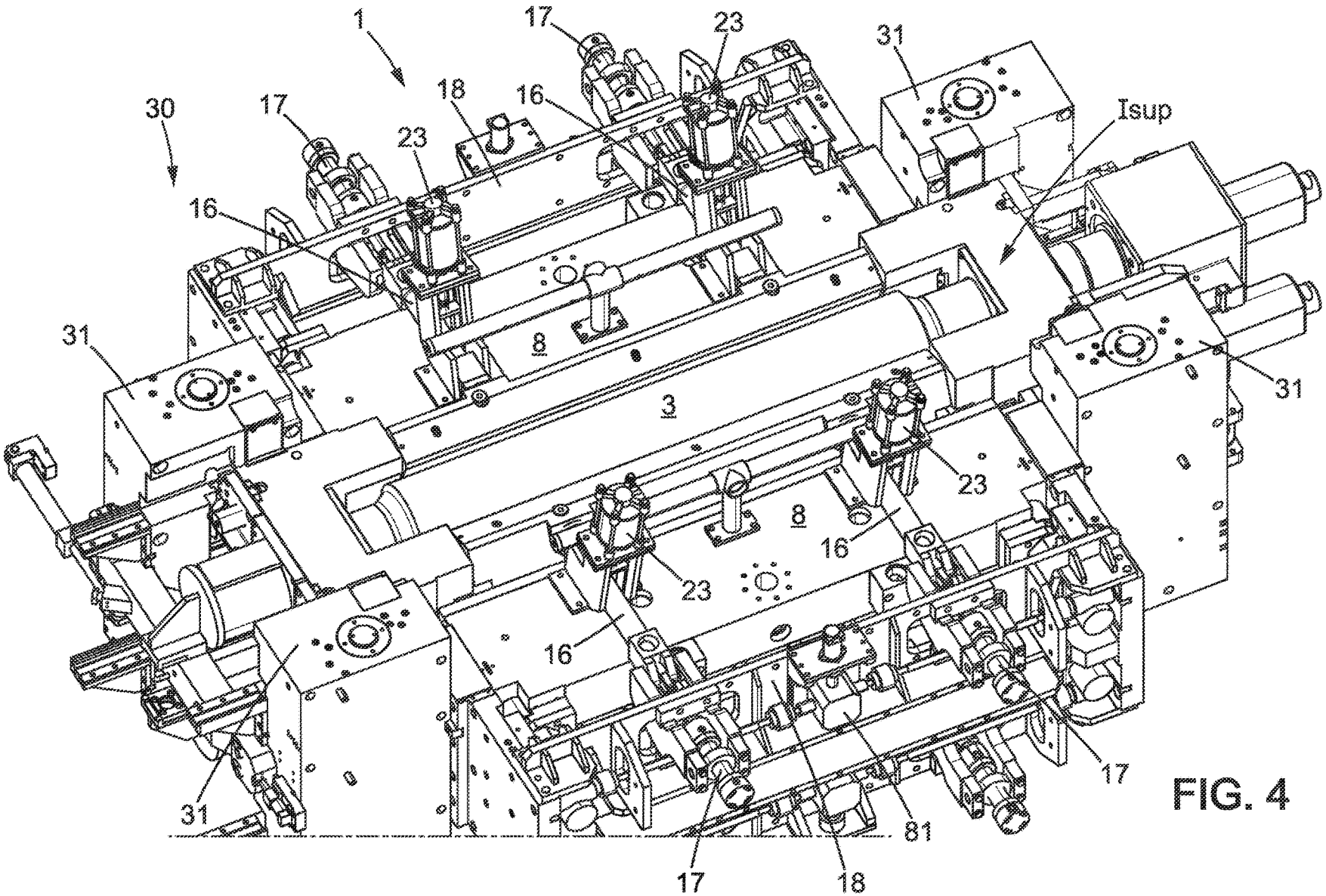
FIG. 4 is a perspective view of the rolling mill stand, seen from above.

The hollow connector 16, (even said actuator 17) of the device for connection are articulated and configured in such a way that said hollow connector 16, even said actuator 17 accompany the movement of the support arm 6 to which said hollow connector 16 is connected (according to the first connection position) from the open position Po of the stand of the rolling mill to the closed position Pc of the stand, said hollow connector 16 then switching from a separated position Pe of the load spreading beam 8 (see FIG. 2) to a position brought closer Pr of the load spreading beam 8 (see FIG. 3).

The hollow connector or connectors 16 associated with the upper insert Isup, even those associated with the lower insert Iinf, can be provided with second actuators 23. These second actuators 23 are used to maintain the hollow connectors 16 in their separated position Pe, in particular when the hollow connectors 16 are in the second disconnection position (namely not linked to the insert).

The actuator 17, namely the first actuator is thus configured to deploy or retract said hollow connector 16 so as to provide the switching from the second disconnection position to the first connection position P1, or inversely, in the open position Po of the stand, the hollow connectors 16 then in their separated position Pe. The second actuator 23 is an actuator independent of the first actuator 17 that cooperates with said hollow connector 16 and is configured to force said hollow connector 16 into the first separated position Pe of the load spreading beam during the connection.

During stand closing, the second actuator 23 is in a state that authorises the free displacement of the hollow connector then connected to the arm of the insert, during the displacement of the insert to its working position. The second actuator 23 can be fixed on a support integral with the load spreading beam 8.

As shown in FIG. 3, the (or each) second actuator 23 can be provided to accompany the movements of the hollow connector 16 associated with the upper insert Isup to force the hollow connector 16 upwards in the separated position Pe, against gravity. Note that, generally, the second actuator 23 can further be replaced with a spring means (spring blade, torsion spring, pneumatic spring, etc.) of which the return force forces the hollow connector 16 from the position brought closer to the separated position Pe. Note that the lower insert Iinf can be devoid of such a second actuator (or spring means), in that gravity naturally forces the hollow connector or connectors 16 associated with the lower insert downwards, and therefore to its separated position Pe.

The supply circuit can include a hose (not shown) connected to a fluid inlet 24 of the hollow connector 16. During operation, in said first connection position P1, the fluid arrives from the source, passes through the hose to the inlet 24 then flows in the duct 21, along the hollow connector 16, until it reaches the supply opening 15. From this opening, the fluid flows in the support arm 6 through the duct 14 to said at least one nozzle 12 that can be integral with the support of the barrels 52, or said at least one nozzle 12 which can be directly integral on the body of the support arm 6.

Preferably, a plurality of nozzles 12 can be arranged over the length of the support arm 6 in such a way as to be able to cool the working roll and/or the intermediate roll over the entire length thereof. Preferably, said at least one nozzle 12 can be directed in such a way that the stream is directed directly on the strip to be rolled, not directly on the working roll, and in such a way that the stream slides on the strip to be rolled in the direction of the working roll 2.

Such an orientation of the nozzles 12 advantageously makes it possible to effectively cool the working roll when the working roll and the intermediate roll are of small diameters and prohibit directly spraying the working roll.

This orientation of said at least one nozzle 12 makes it possible to cool the working roll, even when the stream is sprayed against the scrolling direction of the strip to be rolled, such as shown in FIG. 2. This is made possible in that said at least one nozzle 12, supported by the pivoting arm 6 is located in the vicinity of the working roll, and in that the invention allows for the obtaining of a substantial fluid flow rate. This proximity and such flow rates make it possible for the stream to slide on the strip against the scrolling direction of the strip until it reaches the working roll.

Alternatively or additionally, said at least one nozzle 12 can be directed in such a way that the stream is directed on the intermediate roll 3, in the vicinity of the contact zone Z between the working roll 2 and the intermediate roll 3, and in such a way that it is driven by the intermediate roll, the fluid of the stream arrives at the working roll 2.

The invention thus makes it possible to place one or more nozzles 12 on the support arms 6, in the vicinity of this zone and thus spray the intermediate roll 3, as close as possible to this zone, not only at the contact zone of the support roll 4/intermediate roll 3. When the intermediate roll 3 is driven in rotation at a substantial speed, most of the fluid of the stream reaches the working roll 2, irrespective of the action of the centrifugal force.

Such nozzles 12, can be provided over all or a portion of the two support arms of the upper lateral support rolls and over all or a portion of the two support arms of the lower lateral support rolls.

According to an advantageous embodiment, the nozzles 12 are provided on the four support arms, a device for connection/disconnection being provided between each support arm and the corresponding load spreading beam.

According to this last embodiment, the invention makes it possible to cool/lubricate:

- each one of the two working rolls, upper and lower, on either side of the surrounding plane of the rolling mill,
- each one of the two intermediate rolls, upper and lower, and also,
- the contact zones of the intermediate rolls 3 and working rolls 2, in particular on either side of the surrounding plane of the rolling mill.

The invention further relates to a method for obtaining a rolling mill in accordance with the invention from an existing rolling mill including:

- a stand 30 comprising two pairs of uprights 31 separated between them at the two ends of the stand, at least two uprights of the same pair defining an access window,
- two working rolls 2, able to surround a strip to be rolled, two support rolls 4, and two intermediate rolls 3, the support rolls 4 and the intermediate rolls 3 being rotatably mounted at the ends thereof on chocks,
- lateral support rolls 5, able to support the working rolls 2 laterally each lateral support roll being borne by a support arm 6, mounted with the ability to pivot on an axis 7,
- load spreading beams 8 extending between the corresponding uprights of each pair, and means 9 for applying a preload on each support arm 6, intended for engaging with one of the support arms at a support surface 10, and comprising at least one preload actuating cylinder 11 integral with one of the load spreading beams 8,
- one or more spray nozzles for a lubricating/cooling fluid.

According to the method in accordance with the invention, the device 13 for connection/disconnection is added to the existing rolling mill by implementing the following steps:

- all or a portion of the existing support arms of the rolling mill are replaced with support arms 6 carrying said at least one of the nozzles 12, and including the duct 14 having a supply opening 15 opening onto the outer surface 10,
- the hollow connector 16 is added, movable with respect to the stand 30, as well as the actuator 17, where applicable the first actuator, for the displacement of the hollow connector, able to create a sealed connection with the supply opening 15 on the outer surface 10 in the first connection position P1, or on the contrary retract into the second disconnection position, at a distance from the outer surface 10, and where applicable the second actuator 23 is added, independent of the first actuator 17 cooperating with said hollow connector 16 and being configured to force said hollow connector 16 to the first separated position Pe of the load spreading beam. The actuator 17, in particular the first actuator can be fixed to the fixed beam 18, and the second actuator 23 to the load spreading beam 8.

It is then sufficient to connect the hoses to the fluid inlets 24 of the hollow connectors 16.

Naturally, other embodiments, can have been considered by those skilled in the art without however leaving the scope of the invention defined by the claims hereinafter.

NOMENCLATURE

1. Rolling mill,
2. Working roll,
3. Intermediate roll,
4. Support roll
5. Lateral support roll,
6. Support arm (Lateral support roll 5),
7. Pivot axis (Support arm 6),
8. Load spreading beam,
9. Means for applying a preload,
10. Outer surface (Support arm 6),
11. Actuating cylinder (Means for applying a preload),
12. Spray nozzles
13. Device for connection/disconnection,

14. Duct (Support arm),
15. Supply opening,
16. Hollow connector,
17. Actuator (first actuator),
18. Fixed beam,
19. Articulation connecting the actuator 17 to the hollow connector 16,
23. Second actuator,
81. Screw/nut actuator (adjustment of the horizontal position of the load spreading beam)
20, 21. First and second tubular part of the ball joint system
30. Stand,
31. Uprights,
50, 51 Axes (support of the barrels),
52. Barrels,
81. Screw/nut actuators,
B. Strip to be rolled,
P1. First connection position
Pe. Position separated from the hollow connector in relation to the load spreading beam,
Pr. Position brought closer together of the hollow connector in relation to the load spreading beam,
Po. Open stand position of the rolling mill,
Pc. Closed stand position of the rolling mill

The invention claimed is:

1. Rolling mill (1) comprising:

a stand (30) comprising two pairs of uprights (31) separated between them at the two ends of the stand, at least two uprights of the same pair defining an access window, two working rolls (2), able to surround a strip to be rolled, two support rolls (4), and two intermediate rolls (3), the support rolls (4) and the intermediate rolls (3) being rotatably mounted at the ends thereof on chocks, lateral support rolls (5), able to support the working rolls (2) laterally, each lateral support roll being borne by a support arm (6), mounted with the ability to pivot on an axis (7), load spreading beams (8) extending between the corresponding uprights of each pair, and means (9) for applying a preload on each support arm (6), intended for engaging with one of the support arms at a support surface (10), and comprising at least one preload actuating cylinder (11) integral with one of the load spreading beams (8), one or more spray nozzles for a lubricating/cooling fluid, and wherein at least one of the nozzles (12), is carried on one of the support arms (6) and in which the fluid supply circuit for the said at least one nozzle (12) comprises a device (13) for connection/disconnection comprising:

a duct (14) of the support arm (6), intended for channelling the fluid, having a supply opening (15) opening onto the outer surface of the support arm located on the side of the means (9) for applying a preload, a hollow connector (16), movable with respect to the stand (30), which can be displaced under the action of an actuator (17) able to create a sealed connection with the supply opening (15) on the outer surface (10) in a first connection position (P1), or on the contrary retract into a second disconnection position, at a distance from the outer surface (10), wherein said actuator (17) is an actuator distinct from the actuating cylinder (11) of said means (9) for applying a preload.

2. The rolling mill according to claim 1 wherein the connection end of the hollow connector (16) and the seat around the supply opening (15) intended for receiving as support said connection end include complementary reliefs, mutually engaged, prohibiting any relative sliding between the connection end of the hollow connector (16) and the seat, in said first connection position (P1).

3. The rolling mill according to claim 2, wherein the hollow connector (16) is provided as floating in relation to the frame of the stand, able to accompany the movements of the support arm (6) during rolling operations in the first connection position (P1), said hollow connector (16) being configured to be articulated with respect to the stand of the rolling mill in order to allow the connection end of the hollow connector (16) to follow the movements of the support arm (6).

4. The rolling mill according to claim 1, wherein the hollow connector (16) is a rigid body that forms a duct that has a free longitudinal end intended for being connected to or disconnected from the supply opening (15) of the support arm (6), the other longitudinal end being integral with the actuator (17).

5. The rolling mill according to claim 4, wherein said actuator (17) is an actuating cylinder of which the body of the actuating cylinder is fixed to a fixed stand portion, and the rod of the actuating cylinder is integral with said other end of the hollow portion (16), via an articulation (19).

6. The rolling mill according to claim 4, wherein the hollow connector (16) includes at the connection end a ball joint system, including a first tubular part (20) and a second tubular part (21) having hemispherical contact surfaces, the first part (20) rigidly integral with the body forming a hollow connector (16), the second part (21), free to be oriented with respect to the body of the hollow connector (16).

7. The rolling mill according to claim 1, comprising means for adjusting the horizontal position of each load spreading beam (8), suitable for bringing closer together or separating the load spreading beam (8) from a support arm (6) facing, said spreading beam being in an adjustable position with respect to a fixed beam (18) integral via its ends with two of the uprights at the two ends of the stand, and wherein said actuator (17) is fixed to the fixed beam (18), connecting the fixed beam (18) and the hollow connector (16).

8. The rolling mill according to claim 1, wherein each support arm (6) of a lateral support roll (5) is mounted with the ability to pivot on said axis (7), constituted by a shaft integral with the chocks of one of the intermediate rolls (3), each intermediate roll (3), chocks of the intermediate roll, lateral support rolls (5) and corresponding support arms (6) forming a self-supporting unit, called insert, said rolling mill comprising a lower insert (Iinf) and an upper insert (Isup), said inserts able to be removed or introduced by sliding through the access window during maintenance in an open position (Po) of the stand for which the upper and lower inserts (Isup, Iinf) are separated from the rolling plane, the upper and lower inserts (Isup, Iinf) able to switch to a working position in a closed stand position (Pc)

and wherein the device for connection is configured in such way that the passage from the second disconnection position to the first connection position (P1), is obtained under the action of the deployment of the actuator (17) in the open position (Po) of the stand, in the separated position of the lower and upper inserts, and wherein said hollow connector (16), even said actuator (17) of the device for connection are articulated and configured in such a way that said hollow connector (16), even said actuator (17) accompany the movement of the support arm (6) to which said hollow connector (16) is connected, from the open position (Po) of the stand to the closed position (Pc) of the stand, said hollow connector (16) then switching from a separated position (Pe) of the load spreading beam (8) to a position brought closer (Pr) of the load spreading beam (8).

9. The rolling mill according to claim 8, wherein said actuator (17) is a first actuator configured to deploy or retract said hollow connector (16) so as to provide the switching from the second disconnection position to the first connection position (P1), or inversely, in the open position (Po) of the stand and wherein a second actuator (23), independent of the first actuator (17) or a spring means cooperates with said hollow connector (16) and is configured to force said hollow connector (16) into the first separated position (Pe) of the load spreading beam when said hollow connector (16) is in said second disconnection position.

10. The rolling mill according to claim 9, wherein said second actuator (23) is fixed on a support integral with the load spreading beam (8).

11. The rolling mill according to claim 1, wherein each lateral support roll (5) is supported by backing rollers, the backing rollers being mounted on axes (50, 51) of the support arms (6) by bearings, and wherein the support arm (6) comprises a lubricant supply circuit for the bearings, distinct from the supply circuit of said at least one nozzle (12).

12. The rolling mill according to claim 11, wherein the lubricant supply circuit for the bearings comprises the shaft whereon is pivotably mounted the support arm (6), said shaft being hollow.

13. The rolling mill according to claim 2, wherein the hollow connector (16) is a rigid body that forms a duct that has a free longitudinal end intended for being connected to or disconnected from the supply opening (15) of the support arm (6), the other longitudinal end being integral with the actuator (17).

14. The rolling mill according to claim 3, wherein the hollow connector (16) is a rigid body that forms a duct that has a free longitudinal end intended for being connected to or disconnected from the supply opening (15) of the support arm (6), the other longitudinal end being integral with the actuator (17).

15. The rolling mill according to claim 5, wherein the hollow connector (16) includes at the connection end a ball joint system, including a first tubular part (20) and a second tubular part (21) having hemispherical contact surfaces, the first part (20) rigidly integral with the body forming a hollow connector (16), the second part (21), free to be oriented with respect to the body of the hollow connector (16).

16. The rolling mill of claim 7, wherein the means for adjusting the horizontal position of each load spreading beam (8) is a screw/nut actuator.

17. The rolling mill according to claim 2, comprising means for adjusting the horizontal position of each load spreading beam (8), suitable for bringing closer together or separating the load spreading beam (8) from a support arm (6) facing, said spreading beam being in an adjustable position with respect to a fixed beam (18) integral via its ends with two of the uprights at the two ends of the stand, and wherein said actuator (17) is fixed to the fixed beam (18), connecting the fixed beam (18) and the hollow connector (16).

18. The rolling mill according to claim 3, comprising means for adjusting the horizontal position of each load spreading beam (8), suitable for bringing closer together or separating the load spreading beam (8) from a support arm (6) facing, said spreading beam being in an adjustable position with respect to a fixed beam (18) integral via its ends with two of the uprights at the two ends of the stand, and wherein said actuator (17) is fixed to the fixed beam (18), connecting the fixed beam (18) and the hollow connector (16).

19. The rolling mill according to claim 4, comprising means for adjusting the horizontal position of each load spreading beam (8), suitable for bringing closer together or separating the load spreading beam (8) from a support arm (6) facing, said spreading beam being in an adjustable position with respect to a fixed beam (18) integral via its ends with two of the uprights at the two ends of the stand, and wherein said actuator (17) is fixed to the fixed beam (18), connecting the fixed beam (18) and the hollow connector (16).

20. A method for obtaining a rolling mill, comprising:

providing a stand comprising two pairs of uprights separated between them at the two ends of the stand, at least two uprights of the same pair defining an access window, providing two working rolls, able to surround a strip to be rolled, two support rolls, and two intermediate rolls, the support rolls and the intermediate rolls being rotatably mounted at the ends thereof on chocks, providing lateral support rolls, able to support the working rolls laterally, each lateral support roll being borne by a support arm, mounted with the ability to pivot on an axis, providing load spreading beams extending between the corresponding uprights of each pair, and means for applying a preload on each support arm, intended for engaging with one of the support arms at a support surface, and comprising at least one preload actuating cylinder integral with one of the load spreading beams, providing one or more spray nozzles for a lubricating/cooling fluid, and wherein at least one of the nozzles, is carried on one of the support arms and in which the fluid supply circuit for the said at least one nozzle comprises a device for connection/disconnection comprising:

providing a duct of the support arm, intended for channelling the fluid, having a supply opening opening onto the outer surface of the support arm located on the side of the means for applying a preload, and providing a hollow connector, movable with respect to the stand, which can be displaced under the action of an actuator able to create a sealed connection with the supply opening on the outer surface in a first connection position, or on the contrary retract into a second disconnection position, at a distance from the outer surface, wherein said actuator is an actuator distinct from the actuating cylinder of said means for applying a preload.

* * * * *